US009562431B2

(12) United States Patent
Fries et al.

(10) Patent No.: US 9,562,431 B2
(45) Date of Patent: Feb. 7, 2017

(54) TIP FOR A PICK TOOL, METHOD OF MAKING SAME AND PICK TOOL COMPRISING SAME

(71) Applicant: ELEMENT SIX ABRASIVES S.A., Luxembourg (LU)

(72) Inventors: Robert Fries, Springs (ZA); Cornelis Roelof Jonker, Springs (ZA)

(73) Assignee: Element Six Abrasives S.A., Luxembourg (LU)

( * ) Notice: Subject to any disclaimer, the term of this patent is extended or adjusted under 35 U.S.C. 154(b) by 0 days.

(21) Appl. No.: 14/351,053

(22) PCT Filed: Oct. 26, 2012

(86) PCT No.: PCT/EP2012/071285

§ 371 (c)(1),
(2) Date: Apr. 10, 2014

(87) PCT Pub. No.: WO2013/064433

PCT Pub. Date: May 10, 2013

(65) Prior Publication Data

US 2014/0265530 A1 Sep. 18, 2014

Related U.S. Application Data

(60) Provisional application No. 61/553,393, filed on Oct. 31, 2011.

(30) Foreign Application Priority Data

Oct. 31, 2011 (GB) ..... 1118739.0

(51) Int. Cl.
*E21C 35/18* (2006.01)
*E21C 35/197* (2006.01)
(Continued)

(52) U.S. Cl.
CPC ..... *E21C 35/197* (2013.01); *B22F 7/06* (2013.01); *C22C 1/00* (2013.01); *E21B 10/567* (2013.01);
(Continued)

(58) Field of Classification Search
CPC ..... E21C 35/183
(Continued)

(56) References Cited

U.S. PATENT DOCUMENTS 4,694,918 A 9/1987 Hall
4,811,801 A 3/1989 Salesky et al.
(Continued)

FOREIGN PATENT DOCUMENTS

CN 101523014 A 2/2009
CN 102224317 A 10/2011
(Continued)

OTHER PUBLICATIONS

Great Britain Patent Application No. GB1118739.0, United Kingdom Combined Search and Examination Report mailed Dec. 19, 2011, 8 pages.
(Continued)

*Primary Examiner* — John Kreck
(74) *Attorney, Agent, or Firm* — Dean W. Russell; Clark F. Weight; Kilpatrick Townsend & Stockton LLP

(57) ABSTRACT

A tip for a pick tool, comprising a polycrystalline diamond (PCD) structure joined to a substrate body. The PCD structure has a strike surface including an apex opposite a boundary with the substrate body. At least an outer volume of the PCD structure contains filler material between diamond grains, the content of the filler material being more than 5 weight percent of the PCD material in the outer volume. The outer volume is proximate at least an area of the strike surface including the apex, and the thickness of the
(Continued)

PCD structure between the apex and the boundary with the substrate body is at least 2.5 mm.

17 Claims, 3 Drawing Sheets

(51) Int. Cl.

| | |
|---|---|
| ***E21B 10/567*** | (2006.01) |
| ***C22C 1/00*** | (2006.01) |
| ***E21C 35/183*** | (2006.01) |
| ***E21B 10/573*** | (2006.01) |
| ***B22F 7/06*** | (2006.01) |

(52) U.S. Cl.
CPC ..... *E21B 10/5735* (2013.01); *E21C 35/183* (2013.01); *E21C 2035/1813* (2013.01); *E21C 2035/1816* (2013.01)

(58) Field of Classification Search
USPC ..... 299/113, 110
See application file for complete search history.

(56) References Cited

U.S. PATENT DOCUMENTS

| | | | | |
|---|---|---|---|---|
| 5,453,105 | A | 9/1995 | Middlemiss et al. | |
| 5,766,394 | A | 6/1998 | Anderson et al. | |
| 5,871,060 | A | 2/1999 | Jensen et al. | |
| 6,179,886 | B1 | 1/2001 | Gordeev et al. | |
| 6,446,740 | B2 | 9/2002 | Eyre | |
| 6,447,852 | B1 | 9/2002 | Gordeev et al. | |
| 6,709,747 | B1 | 3/2004 | Gordeev et al. | |
| 6,719,074 | B2 | 4/2004 | Tsuda et al. | |
| 6,919,040 | B2 | 7/2005 | Fries et al. | |
| 7,008,672 | B2 | 3/2006 | Gordeev et al. | |
| 7,320,505 | B1 | 1/2008 | Hall et al. | |
| 7,588,102 | B2 | 9/2009 | Hall et al. | |
| 2002/0194955 | A1* | 12/2002 | Fang | C09K 3/1418 75/240 |
| 2006/0166615 | A1* | 7/2006 | Tank | B22F 7/06 451/540 |
| 2008/0283256 | A1 | 11/2008 | Hall et al. | |
| 2008/0309148 | A1 | 12/2008 | Hall et al. | |
| 2009/0133938 | A1 | 5/2009 | Hall et al. | |
| 2009/0267403 | A1 | 10/2009 | Hall et al. | |
| 2009/0273224 | A1 | 11/2009 | Hall | |
| 2010/0065338 | A1 | 3/2010 | Hall et al. | |
| 2011/0029461 | A1 | 2/2011 | Hardin, Jr. | |
| 2011/0031032 | A1 | 2/2011 | Mourik et al. | |
| 2011/0175430 | A1 | 7/2011 | Heiderich et al. | |
| 2011/0291461 | A1 | 12/2011 | Hall et al. | |

FOREIGN PATENT DOCUMENTS

| | | | | |
|---|---|---|---|---|
| DE | WO 2009053903 | A2 * | 4/2009 | E21B 10/5673 |
| EP | 0116403 | A1 | 8/1984 | |
| EP | 2053198 | A1 | 4/2009 | |
| GB | 2455860 | A | 6/2009 | |
| GB | 2490793 | A | 11/2012 | |
| JP | H02503454 | A | 10/1990 | |
| JP | 2002349173 | A | 12/2002 | |
| JP | 2005516139 | A | 6/2005 | |
| WO | 03064806 | A1 | 8/2003 | |
| WO | WO 2008105915 | A2 * | 5/2008 | |
| WO | 2008105915 | A2 | 9/2008 | |
| WO | 2009013713 | A2 | 1/2009 | |
| WO | 2010046860 | A1 | 4/2010 | |
| WO | 2011017582 | A2 | 2/2011 | |
| WO | 2011042566 | A1 | 4/2011 | |

OTHER PUBLICATIONS

Great Britain Patent Application No. GB1219290.2, United Kingdom Combined Search and Examination Report mailed Apr. 25, 2013, 7 pages.
International Patent Application No. PCT/EP2012/071285, International Search Report and Written Opinion mailed Nov. 6, 2013, 10 pages.
Japanese Patent Application No. 2014-537637, Office Action mailed May 8, 2015, 12 pages.
Chinese Patent Application No. 201280061893.X, Office Action mailed Jun. 12, 2015, 15 pages.
International Patent Application No. PCT/EP2012/071285, International Preliminary Report on Patentability mailed May 15, 2014, 7 pages.

* cited by examiner

TIP FOR A PICK TOOL, METHOD OF MAKING SAME AND PICK TOOL COMPRISING SAME

CROSS REFERENCE TO RELATED APPLICATIONS

This application is the U.S. national phase of International Application No. PCT/EP2012/071285 filed on Oct. 26, 2012, and published in English on May 10, 2013 as International Publication No. WO 2013/064433 A2, which application claims priority to Great Britain Patent Application No. 1118739.0 filed on Oct. 31, 2011 and U.S. Provisional Application No. 61/553,393 filed on Oct. 31, 2011, the contents of all of which are incorporated herein by reference.

This disclosure relates generally to tip for pick tools, method for making same and pick tools comprising same, in which the tips comprise a polycrystalline diamond (PCD) structure.

United States patent application publication number 2010/0065338 discloses a high impact resistant tool having a super-hard material bonded to a cemented metal carbide substrate at a non-planar boundary. The super-hard material may be a polycrystalline structure with an average grain size of 10 to 100 microns and preferably comprise a 1 to 5 percent cobalt concentration by weight.

United States patent application publication number 2009/0273224 discloses a high impact wear resistant tool having a super-hard material bonded to a cemented metal carbide substrate at a non-planar boundary. The super-hard material has a thickness of at least 0.100 inch and forms an included angle of 35 to 55 degrees. The super-hard material has a plurality of substantially distinct diamond layers. Each layer of the plurality of layers has a different catalysing material concentration. A diamond layer adjacent the substrate of the super-hard material has a higher catalysing material concentration than a diamond layer at a distal end of the super-hard material. The diamond layer adjacent the substrate may have a catalysing material concentration between 5 and 10 percent. The diamond layer at the distal end of the super-hard material may have a catalysing material concentration between 2 percent and 5 percent. The diamond layer at the distal end of the super-hard material may be leached and comprise a catalysing material concentration of 0 to 1 percent.

U.S. Pat. No. 7,588,102 discloses a tool comprising a sintered body of diamond particles in a metal matrix bonded to a cemented metal carbide substrate at a non-planar interface. A strike surface has at least one region far enough away from the non-planar interface that during high pressure, high temperature processing a restricted amount of metal from the substrate reaches the region, the amount comprising 5 to 0.1 percent of the region by volume, resulting in the region having a high density of diamond particles. The patent further discloses a method for manufacturing a high impact resistant tool, the method including the steps of providing a body of diamond or diamond-like particles and a cemented metal carbide substrate with a non-planar interface, the body comprising a strike surface with a region at least 0.100 to 0.500 inches away from the interface and sintering the body to a substrate in a high pressure, high temperature process just long enough for the cobalt to reach the region such that the cobalt concentration becomes 5 to 0.1 percent of the volume of the region.

There is a need for a pick tool comprising a PCD tip having high resistance to fracture.

Viewed from a first aspect there is provided a tip for a pick tool, comprising a polycrystalline diamond (PCD) structure joined to a substrate body, the PCD structure having a strike surface including an apex opposite a boundary with the substrate body; in which at least an outer volume of the PCD structure contains filler material between diamond grains, the content of the filler material being more than 5 weight percent of the PCD material in the outer volume; the outer volume being proximate (i.e. adjacent, near, or spaced apart by at most 50 microns from) at least an area of the strike surface including the apex and the thickness of the PCD structure between the apex and the boundary with the substrate body being at least about 2.5 mm or at least about 3 mm.

Various arrangements and combinations are envisages for disclosed tips, of which the following are non-exhaustive, non-limiting examples, features of which may be present in combination with features of other examples.

In some example arrangements, the filler material may comprise or consist essentially of catalyst material for diamond or it may be substantially free of catalyst material for diamond. For example, the filler material may comprise cobalt, iron and or nickel. In some examples, the PCD structure may substantially consist of PCD material containing filler material, the content of the filler material being more than 5 weight percent of the PCD material.

The area of the strike surface may extend over substantially the entire strike surface of the PCD structure, or over at least a generally conical portion of the strike surface.

The outer volume may extend from the area of the strike surface to a depth of at least 100 microns from the area of the strike surface or it may extend from a depth of at most 50 microns from the area of the strike surface to a depth of at least 100 microns from the area of the strike surface. In some arrangements, the PCD structure may be substantially free of filler material within a zone extending from the area of the strike surface to a depth of at most 50 microns from the area of the strike surface.

The outer volume region may include a region adjacent the area of the strike surface having a catalyst content of less than 5 weight percent or being substantially free of catalyst material to a depth from the area of the strike surface of no more than about 50 microns from the area of the strike surface, or the outer volume may comprise more than 5 weight percent catalyst material directly adjacent the strike surface.

The strike surface of the PCD structure may define a generally rounded conical shape, the apex being the rounded point of the cone. The boundary between the PCD structure and the substrate body may be substantially planar or non-planar, and may include a depression in the substrate body and or a projection from the substrate body. A depression in the substrate body may be arranged generally opposite the apex of the PCD structure. In some arrangements, the substrate is configured such that the boundary surface includes a convex region projecting from the substrate body opposite the apex. The convex region may be part of a generally continuously convex boundary surface defined by the substrate body (apart from relatively minor depressions and or projections included on the boundary surface), or the convex region may surrounded by region having a planar or other non-convex shape.

The PCD structure may consist substantially of a single grade of PCD or it may comprise a plurality of PCD grades arranged in various ways, such as in layered or lamination arrangements. The content of catalyst material throughout the PCD structure may be substantially uniform, substantially non-uniform or vary within a range from at least about 5 weight percent to about 20 weight percent of the PCD material. The PCD structure comprises a plurality of strata arranged so that adjacent strata comprise different PCD grades, adjacent strata being directly bonded to each other by inter-growth of diamond grains.

The strike surface may define a generally conical shape including a rounded apex having a longitudinal radius of curvature of at least about 1 mm and at most about 4 mm (i.e. in a plane through the apex and intersecting the boundary with the substrate), the strike surface arranged opposite the boundary with the substrate body. The thickness of the PCD structure between the apex and the boundary with the substrate body may be at most about 10 mm. At least part of the strike surface or a tangent to at least part of the strike surface may be disposed at an angle to a peripheral side of the tip, the angle being at least about 35 degrees and at most about 55 degrees, the peripheral side of the tip including a peripheral side of the substrate. In one particular example, the angle may be substantially 43 degrees. In some arrangements, the volume of the PCD structure may be at least 70 percent and at most 150 percent of the volume of the substrate body; and in another arrangement the PCD structure may have a volume of less than 70 percent and greater than 50 percent of the volume of the substrate.

In some example arrangements, the tip may comprise an intermediate volume between the PCD structure and the substrate, the intermediate volume being greater than the volume of the PCD structure and comprising an intermediate material having a mean Young's modulus at least 60% and at most 90% that of the PCD material.

Viewed from a second aspect there is provided a method of making a tip according to this disclosure, the method including providing an aggregation comprising a plurality of diamond grains and a source of catalyst for diamond, forming the aggregation into a configuration suitable for sintering a PCD structure according to the disclosure, the aggregation disposed against an inner boundary with a substrate body or an intermediate substrate body to form a pre-sinter assembly, the source of catalyst material being provided at least in a region of the aggregation proximate an outer boundary remote from the inner boundary, and subjecting the pre-sinter assembly to a pressure and temperature at which the diamond grains can be sintered together to form a PCD structure having a strike surface remote from the inner boundary, a region of the PCD structure within a depth of about 100 microns from the strike surface or adjacent the strike surface comprising more than 5 weight percent catalyst material; in which the thickness of the aggregation between the apex and the inner boundary is at least about 2.5 mm or at least about 3 mm.

The thickness of the aggregation between the apex and the boundary is to be sufficiently large such that the thickness of the sintered PCD structure between the apex and the boundary with the substrate will be at least about 2.5 mm, taking into consideration a potential change in dimensions of the aggregation as it becomes sintered to form the PCD structure.

Various arrangements and combinations are envisaged for the method by the disclosure. For example, the aggregation may be configured to have a generally conical outer boundary remote from an inner boundary with the substrate body or the intermediate substrate body. The outer boundary may include a rounded apex. In one arrangement, the inner boundary may include a depression opposite the apex.

Viewed from a third aspect there can be provided a pick assembly comprising a tip according to this disclosure. The tip may be joined to support body mounted in a steel base, the support body comprising an insertion shaft; the steel base having a bore configured to accommodate the insertion shaft and comprising an attachment member for coupling the steel base to a tool carrier such as a pick drum; the volume of the support body being at least 6 $cm^3$, at least 10 $cm^3$ or at least 15 $cm^3$. The insertion shaft may be shrink-fitted within the bore. In some examples, the substrate body may comprise cemented carbide having magnetic saturation of at least about 7 $G.cm^3/g$ and at most about 11 $G.cm^3/g$ and coercivity of at least about 9 kA/m and at most about 14 kA/m. The substrate body may comprise or consist of cemented carbide material including at least about 5 weight percent cobalt and at most about 8 weight percent cobalt, Rockwell hardness of at least about 90 Ra, transverse rupture strength of at least about 2,500 MPa, and or magnetic coercivity of at least about 120 Oe and at most about 170 Oe. Cemented carbide having relatively low binder content is likely to provide enhanced stiffness and support for the tip in use, which may help reduce the risk of fracture.

Viewed from a fourth aspect there can be provided a pick apparatus comprising a pick tool according to the disclosure, coupled to a vehicle for driving the pick tool against a body to be degraded.

Pick tips according to the disclosure are likely to have enhanced resistance to fracture in use without substantially reduced wear resistance. While wishing not to be bound by a particular theory, this may be because the presence of sufficient material within interstices between the diamond grains proximate the strike surface may enhance the fracture toughness of the tip, one reason for which may be a reduction in the risk of cracks initiating at the strike surface in use. This may result increase the scope for design options for the tip, such as the configuration of the boundary. Consequently, picks according to the disclosure are likely to have extended working life.

The disclosed method has the aspect that relatively thick PCD structures can be made in which the catalyst content adjacent surfaces remote from the boundary between the PCD structure and the substrate can be relatively high. While wishing not to be bound by a particular theory, this may be because the method does not rely on infiltration of catalyst material from a source, which may result in the content of the catalyst material remote from the source being substantially less than that adjacent the source. The higher cobalt content near the working surface is likely to improve the fracture resistance of the pick tip in use, which may be further enhanced in combination with other disclosed aspects of the tip arrangement, which are likely to affect the stress state of the PCD structure and or the dynamics of crack propagation within the PCD structure. While other properties and aspects such as the abrasion resistance may be affected, this does not appear to affect deleteriously the performance of disclosed tips in use. The method is also likely to have the aspect that certain deleterious effects of infiltration of cobalt from the substrate into the diamond aggregation may be reduced, and in particular there is likely to be a significant reduction in cobalt pooling at the interface between the substrate and the PCD structure. This in turn is expected to reduce the need for more complex non-planar interfaces that on the one hand mitigate against shear failures along the interface but may also induce complex residual stresses.

Non-limiting example arrangements to illustrate the present disclosure are described hereafter with reference to the accompanying drawings, of which:

Figure 1:
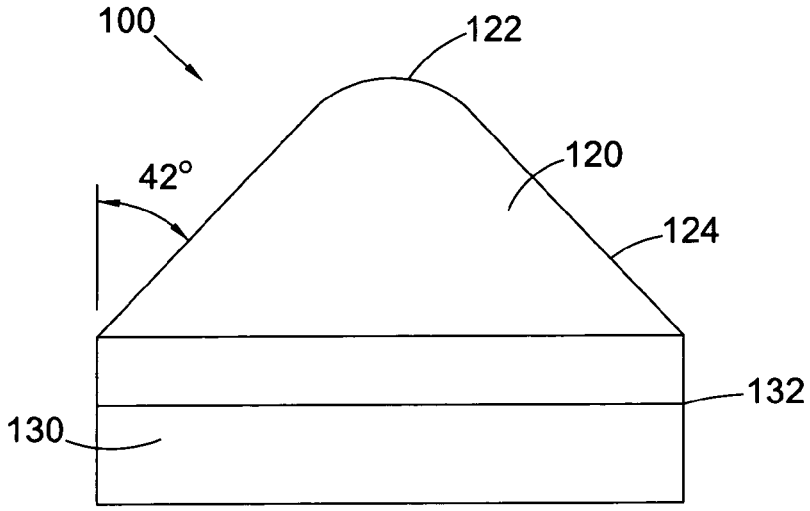
FIG. 1 shows a schematic side view of an example tip for a pick tool.

With reference to FIG. 1, FIG. 2, FIG. 3 and FIG. 4, example tips 100 comprise respective PCD structures 120 joined to respective substrate bodies 130, each PCD structure 120 having a generally conical strike surface 124 including a rounded apex 122 opposite a boundary 132 with the substrate 130. Substantially the entire volume of the PCD structures 120, including adjacent the strike surface 124 comprise at least about 6 or 7 weight percent catalyst material comprising cobalt. The substrates comprise cemented tungsten carbide and the PCD structures comprise at least about 85 volume percent synthetic diamond. The rounded apex has a longitudinal radius of curvature of at least about 1.5 mm and at most about 4 mm (the longitudinal axis is indicated by L in FIG. 2). In one particular arrangement, the radius of curvature may be about 2.25 mm.

Figure 2:
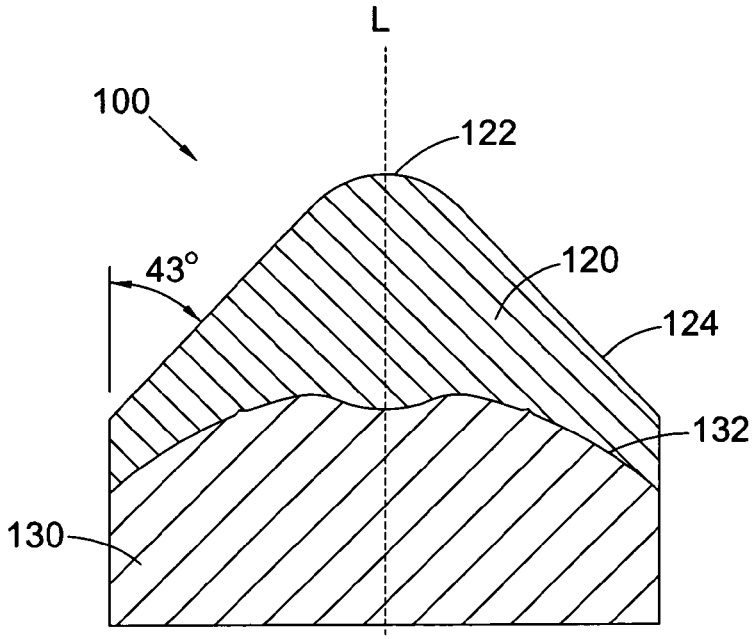
FIG. 2, FIG. 3 and FIG. 4 show cross section views of example tips for a pick tool.

In the example tip 100 illustrated in FIG. 2, the boundary 132 between the PCD structure 120 and the substrate 130 includes a depression in the substrate 130 opposite the apex 122 of the PCD structure. The depression is formed into an otherwise generally dome-like end of the substrate 130, forming a hollow-point in which the depression is at least partially surrounded by a ridge. The depression may have a longitudinal radius of curvature (i.e. in a plane parallel to L) of at least about 0.5 mm and at most about 10 mm, and a depth from a surrounding ridge of at least about 0.1 mm and at most about 1 mm. The PCD structure may a height from the apex 122 to the bottom of the depression of at least about 3 mm and at most about 8 mm or at most about 10 mm.

Figure 3:
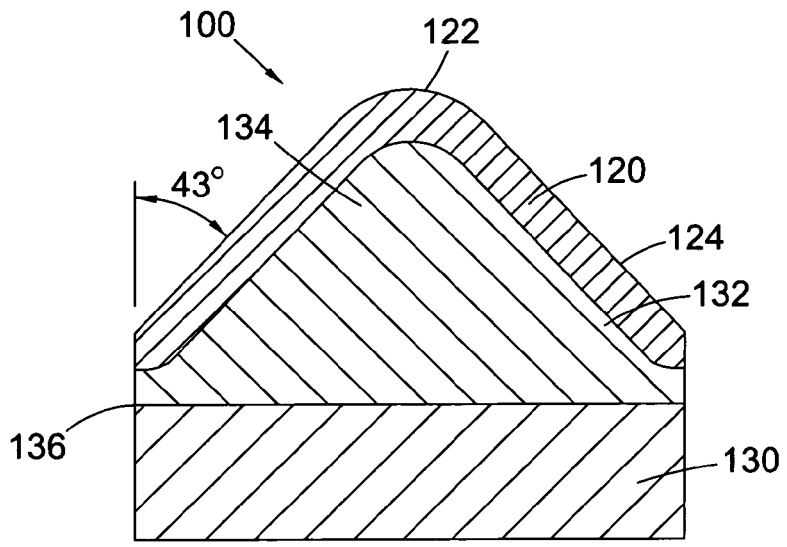

In the example tip 100 illustrated in FIG. 3, an intermediate substrate 134 is disposed between the PCD structure 120 and the substrate 130, the boundary 132 between the PCD structure and the intermediate substrate 134 is generally conical and generally conformal with the strike surface 124. The intermediate substrate 134 is joined to the substrate at a boundary 136, remote from the PCD structure 122, and comprises metal carbide grains and diamond grains. The intermediate structure 134 has a stiffness that is intermediate that of the PCD structure 120 and the substrate 130, and may comprise a material having a Young's modulus at least about 650 GPa and at most about 900 GPa, and the Young's modulus of the PCD structure is at least about 1,000 GPa.

Figure 4:
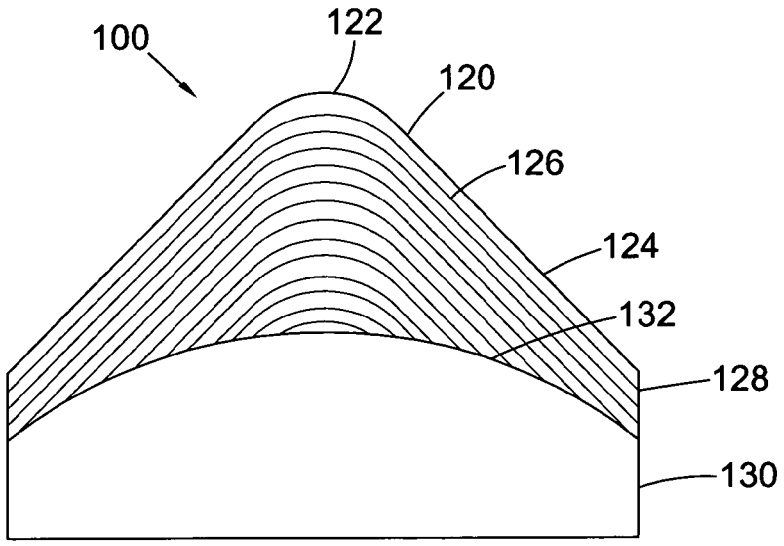

In the example tip 100 illustrated in FIG. 4, each of the PCD structures 120 comprises a plurality of layers or strata 126, consecutive layers 126 comprising different grades of PCD material arranged alternately. The layers 126 may be configured to direct cracks generated near the strike surface 124 in use away from an inner region of the PCD structure or away from the boundary 132 with the substrate. The layers 126 may be arranged generally conformal with at least part of the strike surface 124, and may have a thickness in the range of around 30 to 300 microns.

Figure 5:
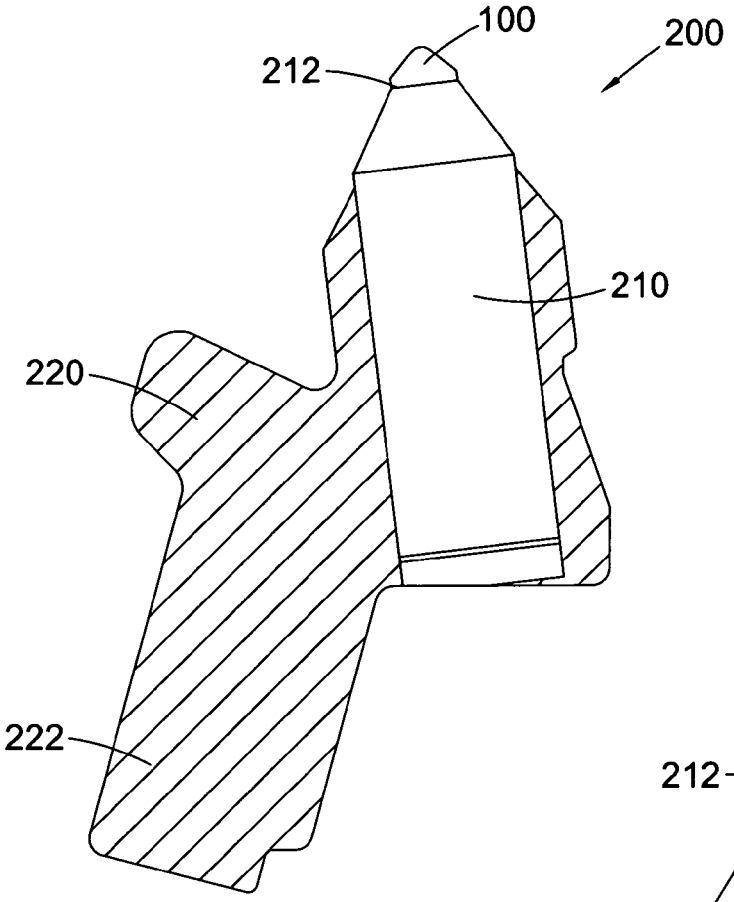
FIG. 5 and FIG. 6 show schematic longitudinal cross section views of example pick tools.
Figure 6:
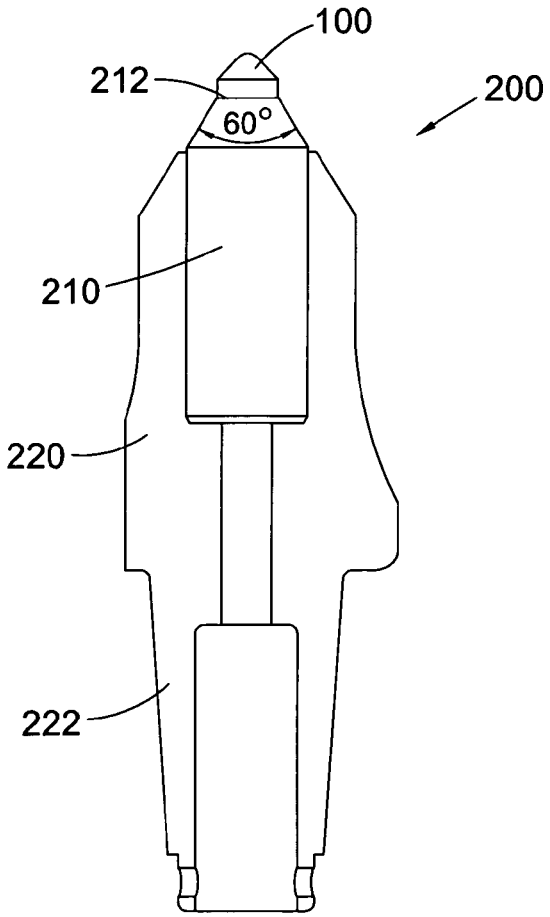

With reference to FIG. 5 and FIG. 6, example pick tool arrangements 200 each comprises a tip 100 joined to a support body 210 at a join interface 212 and the support body 210 comprises an insertion shaft, which is shrink fit into a bore formed into the base 220. The base 220 has a shank 222 for mounting the pick 200 onto a drum (not shown) via a coupling mechanism (not shown). In the example arrangement shown in FIG. 5, the shank 222 is substantially not aligned with the insertion shaft of the support body 210, while in the example arrangement shown in FIG. 6, the shank 222 is generally aligned with the insertion shaft of the support body 210. The volume of the support body 210 may be at least about 10 $cm^3$ and the length of the insertion shaft of the support body 210 may be at least equal to its diameter, and or at least about 4 cm. As used herein, a shrink fit is a kind of interference fit between components achieved by a relative size change in at least one of the components (the shape may also change somewhat). This is usually achieved by heating or cooling one component before assembly and allowing it to return to the ambient temperature after assembly. Shrink-fitting is understood to be contrasted with press-fitting, in which a component is forced into a bore or recess within another component, which may involve generating substantial frictional stress between the components. In some variants, the support body 210 comprises a cemented carbide material comprising grains of metal carbide having a mean size of at most about 8 microns and at most about 10 weight percent of metal binder material, such as cobalt (Co). Shrink fitting the support body 210 into the base 220 may allow relatively stiff grades of cemented carbide to be used, which is likely to enhance support for the tip 100 and reduce the risk of fracture.

Example methods for making a tip comprising a PCD structure formed joined to a substrate will now be described.

In general, a tip may be made by placing an aggregation comprising a plurality of diamond grains onto a cemented carbide substrate body and subjecting the resulting assembly in the presence of a catalyst material for diamond to an ultra-high pressure and high temperature at which diamond is more thermodynamically stable than graphite to sinter together the diamond grains and for a PCD structure joined to the substrate body. Binder material within the cemented carbide substrate body may provide a source of the catalyst material, such as cobalt, iron or nickel, or mixtures or alloys including any of these. A source of catalyst material may be provided within the aggregation of diamond grains, in the form of admixed powder or deposits on the diamond grains, for example. A source of catalyst material may be provided proximate a boundary of the aggregation other than the boundary between the aggregation and the substrate body, for example adjacent a boundary of the aggregation that will correspond to the strike surface of the sintered PCD structure.

In some example methods, the aggregation may comprise substantially loose diamond grains, or diamond grains held together by a binder material. The aggregations may be in the form of granules, discs, wafers or sheets, and may contain catalyst material for diamond and/or additives for reducing abnormal diamond grain growth, for example, or the aggregation may be substantially free of catalyst material or additives.

In some example methods, aggregations in the form of sheets comprising a plurality of diamond grains held together by a binder material may be provided. The sheets may be made by a method known in the art, such as by extrusion or tape casting methods, in which slurries comprising diamond grains having respective size distributions suitable for making the desired respective PCD grades, and a binder material is spread onto a surface and allowed to dry. Other methods for making diamond-containing sheets may also be used, such as described in U.S. Pat. Nos. 5,766,394 and 6,446,740. Alternative methods for depositing diamond-bearing layers include spraying methods, such as thermal spraying. The binder material may comprise a water-based organic binder such as methyl cellulose or polyethylene glycol (PEG) and different sheets comprising diamond grains having different size distributions, diamond content or additives may be provided. For example, sheets comprising diamond having a mean size in the range from about 10 microns to about 80 microns may be provided discs may be cut from the sheet or the sheet may be fragmented. The sheets may also contain catalyst material for diamond, such as cobalt, and or precursor material for the catalyst material, and or additives for inhibiting abnormal growth of the diamond grains or enhancing the properties of the PCD material. For example, the sheets may contain about 0.5 weight percent to about 5 weight percent of vanadium carbide, chromium carbide or tungsten carbide.

In some versions of the example method, the aggregation of diamond grains may include precursor material for catalyst material. For example, the aggregation may include metal carbonate precursor material, in particular metal carbonate crystals, and the method may include converting the binder precursor material to the corresponding metal oxide, typically by pyrolysis or decomposition, admixing the metal oxide based binder precursor material with a mass of diamond particles, and milling the mixture to produce metal oxide precursor material dispersed over the surfaces of the diamond particles. The metal carbonate crystals may be selected from cobalt carbonate, nickel carbonate, copper carbonate and the like, in particular cobalt carbonate. The catalyst precursor material may be milled until the mean particle size of the metal oxide is in the range from about 5 nm to about 200 nm. The metal oxide may be reduced to a metal dispersion, for example in a vacuum in the presence of carbon and/or by hydrogen reduction. The controlled pyrolysis of a metal carbonate, such as cobalt carbonate crystals provides a method for producing the corresponding metal oxide, for example cobalt oxide ($Co_3O_4$), which can be reduced cobalt metal dispersions. The reduction of the oxide may be carried out in a vacuum in the presence of carbon and/or by hydrogen reduction.

A substrate body comprising cemented carbide in which the cement or binder material comprises a catalyst material for diamond, such as cobalt, may be provided. The substrate body may have a non-planar or a substantially planar proximate end on which the PCD structure is to be formed. For example, the proximate end may be configured to reduce or at least modify residual stress within the PCD. A cup having a generally conical internal surface may be provided for use in assembling the diamond aggregation, which may be in the form of an assembly of diamond-containing sheets, onto the substrate body. The aggregation may be placed into the cup and arranged to fit substantially conformally against the internal surface. The substrate body may then be inserted into the cup with the proximate end going in first and pushed against the aggregation of diamond grains. The substrate body may be firmly held against the aggregation by means of a second cup placed over it and inter-engaging or joining the first and second cups to form a pre-sinter assembly.

The pre-sinter assembly can be placed into a capsule for an ultra-high pressure press and subjected to an ultra-high pressure of at least about 5.5 GPa and a temperature of at least about 1,300 degrees centigrade to sinter the diamond grains and form a construction comprising a PCD structure sintered onto the substrate body. In one version of the method, when the pre-sinter assembly is treated at the ultra-high pressure and high temperature, the binder material within the support body melts and infiltrates the aggregation of diamond grains. The presence of the molten catalyst material from the support body and or from a source provided within the aggregation is likely to promote the sintering of the diamond grains by intergrowth with each other to form a PCD structure.

In operation, the pick tool may be driven forward by a drive apparatus on which it is mounted, against a structure to be degraded and with the tip at the leading end. For example, a plurality of pick tools may be mounted on a drum for asphalt degradation, as may be used to break up a road for resurfacing. The drum is connected to a vehicle and caused to rotate. As the drum is brought into proximity of the road surface, the pick tools are repeatedly impacted into the road as the drum rotates and the leading tips thus break up the asphalt. A similar approach may be used to break up coal formations in coal mining.

Non-limiting example arrangements are described in detail below.

Example 1

A substrate for a tip comprising a PCD structure may be provided by forming a green body comprising a compacted blend of about 8 weight percent Co and 92 weight percent WC grains, machining the green body to the desired shape and sintering the green body to form a substrate comprising cemented carbide material. The substrate may have a proximate end configured as a hollow-point dome, in which a generally dome-shaped end includes a central, substantially circular depression at the nose. The depression may have a depth of about 0.3 mm measured from the top of a surrounding, circular ridge, and it may have a radius of curvature in a longitudinal plane through the centre of the depression of about 1 mm. The proximate end will comprise a circumferential tapering outer volume extending from the ridge to a cylindrical side surface of the substrate, and a plurality of small protrusions may be formed on the tapering surface. The top of the ridge will be rounded.

An aggregation of diamond grains may be provided in the form of a sheet containing diamond grains held together by a binder material. The sheet will comprise diamond grains having a mean size of about 20 microns and be made by means of a tape casting method. This method involves providing slurry of diamond grains, cobalt powder and vanadium carbide powder suspended in liquid binder, casting the slurry into sheet form and allowing it to dry to form a self-supportable diamond-containing sheet. After drying, the sheet will contain about 3 weight percent vanadium carbide and about 1 weight percent cobalt. The sheet may be broken into fragments and the fragments placed into a cup, the inside of which will define the desired shape of the strike surface of the PCD structure (taking into account expected distortion that may occur during sintering), and the proximate end of the substrate may be inserted into the cup and urged against the diamond-containing fragments to form a pre-sinter assembly. The pre-sinter assembly may be outgassed under heat in order to burn off the binder material comprised in the fragments, placed into a capsule for an ultra-high pressure press and subjected to an ultra-high pressure of at least about 6 GPa and a high temperature of at least about 1,300 degrees centigrade to sinter the diamond grains to form a compact comprising PCD impact structure joined to the substrate. The compact may be removed from the capsule and further processed to final dimensions to provide a tip for a pick tool.

It is estimated that impact structure would have a Young's modulus of about 1,036 GPa, a Poisson ratio of about 0.105 and a coefficient of thermal expansion of about $3.69\times10^{-6}$/C; and that the substrate would have a Young's modulus of about 600 GPa, a Poisson ratio of about 0.21 and a coefficient of thermal expansion of about $5.7\times10^{-6}$/C. Using finite element mathematical analysis, it was calculated that the impact structure would include a region of residual axial compressive stress as shown in FIG. 3B.

Example 2

First and second sheets, each containing diamond grains having a different mean size and held together by an organic binder were made by the tape casting method. This method involved providing respective slurries of diamond grains suspended in liquid binder, casting the slurries into sheet form and allowing them to dry to form self-supportable diamond-containing sheets. The mean size of the diamond grains within the first sheet was in the range from about 5 microns to about 14 microns, and the mean size of the diamond grains within the second sheet was in the range from about 18 microns to about 25 microns. Both sheets also contained about 3 weight percent vanadium carbide and about 1 weight percent cobalt. After drying, the sheets were about 0.12 mm thick. Fifteen circular discs having diameter of about 13 mm were cut from each of the sheets to provide first and seconds sets of disc-shaped wafers.

A substrate body formed of cobalt-cemented tungsten carbide may be provided. The substrate body may generally be cylindrical in shape, having a diameter of about 13 mm and a non-planar end formed with a central projecting member. A mold defining a generally conical shape may be provided for assembling a pre-sinter assembly. The diamond-containing wafers may be placed into the mold, alternately stacked on top of each other with discs from the first and second sets inter-leaved. A layer of loose diamond grains having a mean size in the range from about 18 microns to about 25 microns may be placed on top of the uppermost of the wafers, and the substrate body was inserted into the cup, with the non-planar end pushed against the layer.

The pre-sinter assembly thus formed may be assembled into a capsule for an ultra-high pressure press and subjected to a pressure of about 6.8 GPa and a temperature of at least about 1,450 degrees centigrade for about 10 minutes to sinter the diamond grains and form a PCD construction comprising a PCD structure bonded to the substrate body. The PCD construction may be processed by grinding and lapping to finish a tip for a road reconditioning pick.

Certain terms and concepts as used herein are briefly explained below.

Synthetic and natural diamond, polycrystalline diamond (PCD), cubic boron nitride (cBN) and polycrystalline cBN (PCBN) material are examples of superhard materials. As used herein, synthetic diamond, which is also called man-made diamond, is diamond material that has been manufactured. As used herein, polycrystalline diamond (PCD) material comprises a mass (an aggregation of a plurality) of diamond grains, a substantial portion of which are directly inter-bonded with each other and in which the content of diamond is at least about 80 volume percent of the material. Interstices between the diamond grains may be at least partly filled with a binder material comprising a catalyst material for synthetic diamond, or they may be substantially empty. As used herein, a catalyst material for synthetic diamond is capable of promoting the growth of synthetic diamond grains and or the direct inter-growth of synthetic or natural diamond grains at a temperature and pressure at which synthetic or natural diamond is thermodynamically stable. Examples of catalyst materials for diamond are Fe, Ni, Co and Mn, and certain alloys including these. Bodies comprising PCD material may comprise at least a region from which catalyst material has been removed from the interstices, leaving interstitial voids between the diamond grains. As used herein, PCBN material comprises grains of cubic boron nitride (cBN) dispersed within a matrix comprising metal or ceramic material.

As used herein, a PCD grade is a variant of PCD material characterised in terms of the volume content and size of diamond grains, the volume content of interstitial regions between the diamond grains and composition of material that may be present within the interstitial regions. A grade of PCD material may be made by a process including providing an aggregation of diamond grains having a size distribution suitable for the grade, optionally introducing catalyst material or additive material into the aggregation, and subjecting the aggregation in the presence of a source of catalyst material for diamond to a pressure and temperature at which diamond is more thermodynamically stable than graphite and at which the catalyst material is molten. Under these conditions, molten catalyst material may infiltrate from the source into the aggregation and is likely to promote direct intergrowth between the diamond grains in a process of sintering, to form a PCD structure. The aggregation may comprise loose diamond grains or diamond grains held together by a binder material. Different PCD grades may have different microstructure and different mechanical properties, such as elastic (or Young's) modulus E, modulus of elasticity, transverse rupture strength (TRS), toughness (such as so-called $K_1C$ toughness), hardness, density and coefficient of thermal expansion (CTE). Different PCD grades may also perform differently in use. For example, the wear rate and fracture resistance of different PCD grades may be different. The table below shows approximate compositional characteristics and properties of three example PCD grades referred to as PCD grades I, II and III. All of the PCD grades comprise interstitial regions filled with material comprising cobalt metal, which is an example of catalyst material for diamond.

Other examples of superhard materials include certain composite materials comprising diamond or cBN grains held together by a matrix comprising ceramic material, such as silicon carbide (SiC), or cemented carbide material, such as Co-bonded WC material (for example, as described in U.S. Pat. No. 5,453,105 or 6,919,040). For example, certain SiC-bonded diamond materials may comprise at least about 30 volume percent diamond grains dispersed in a SiC matrix (which may contain a minor amount of Si in a form other than SiC). Examples of SiC-bonded diamond materials are described in U.S. Pat. Nos. 7,008,672; 6,709,747; 6,179,886; 6,447,852; and International Application publication number WO2009/013713).

As used herein, a strike surface of a pick tool is a surface that may impactively engage a body or formation to be degraded when the pick tool strikes the body or formation in use.

The invention claimed is:

1. A tip for a pick tool, comprising a polycrystalline diamond (PCD) structure joined to a substrate body, the PCD structure having a strike surface including an apex opposite a boundary with the substrate body, the thickness of the PCD structure disposed between the apex and the boundary with the substrate body being at least 3 mm; in which the PCD structure consists of diamond and filler material, the filler material comprising catalyst material for diamond, the content of the filler material being more than 5 weight percent of the PCD structure and the content of the catalyst material being substantially uniform throughout the PCD structure; including in an outer volume of the PCD structure proximate at least an area of the strike surface including the apex, the outer volume containing filler material between diamond grains, the content of the filler material being more than 5 weight percent of the PCD structure in the outer volume.

2. A tip as claimed in claim 1, in which the boundary includes a depression in the substrate body opposite the apex.

3. A tip as claimed in claim 1, in which the boundary includes a convex region projecting from the substrate body opposite the apex.

4. A tip as claimed in claim 1, comprising an intermediate volume between the PCD structure and the substrate, the intermediate volume being greater than the volume of the PCD structure and comprising an intermediate material having a mean Young's modulus at least 60% and at most 90% that of the PCD structure.

5. A tip as claimed in claim 1, in which the PCD structure comprises a plurality of strata arranged so that adjacent strata comprise different PCD grades, adjacent strata being directly bonded to each other by inter-growth of diamond grains.

6. A tip as claimed in claim 1, in which the strike surface defines a conical shape including a rounded apex having a longitudinal radius of curvature of at least 1 mm and at most 4 mm, the strike surface arranged opposite the boundary with the substrate body.

7. A tip as claimed in claim 1, in which at least part of the strike surface or a tangent to at least part of the strike surface is disposed at an angle to a peripheral side of the tip, the angle being at least 35 degrees and at most 55 degrees, the peripheral side of the tip including a peripheral side of the substrate.

8. A tip as claimed in claim 1, in which the volume of the PCD structure is at least 70 percent and at most 150 percent of the volume of the substrate body.

9. A tip as claimed in claim 1, in which the volume of the PCD structure is greater than 50 percent and less than 70 percent of the volume of the substrate body.

10. A pick tool comprising a tip as claimed in claim 1, the tip being joined to a support body comprising an insertion shaft; the insertion shaft shrink fit within a bore of a steel base, the steel base comprising a coupling shank for coupling the pick to a carrier vehicle.

11. A pick tool as claimed in claim 10, in which the substrate body comprises cemented carbide having magnetic saturation in the range from 7 $G.cm^3/g$ to 11 $G.cm^3/g$ and coercivity in the range from 9 kA/m to 14 kA/m.

12. A tip as claimed in claim 1, in which the substrate body comprises cemented carbide material containing 5 to 8 weight percent cobalt.

13. A method of making a tip as claimed in claim 1, comprising a PCD structure having a strike surface remote from an inner boundary with a substrate body; the method including providing a cup having an internal surface configured to define a volume corresponding to a shape having an apex, providing an aggregation comprising a plurality of diamond grains combined with a source of catalyst material for diamond the source of catalyst material being provided at least in a region of the aggregation proximate an outer boundary remote from the inner boundary, such that a region of the PCD structure adjacent the strike surface will comprise more than 5 weight percent catalyst material; disposing the aggregation within the volume and imposing the shape on a proximate end of the aggregation, disposing a substrate body against a distal end of the aggregation so that the aggregation is disposed between the substrate body and the cup to form a pre-sinter assembly; and subjecting the pre-sinter assembly to a pressure and temperature suitable for sintering the diamond in the presence of the catalyst material; in which the thickness of the aggregation between the apex and the inner boundary is at least 3 mm, and sufficiently large such that the thickness of the sintered PCD structure between the apex and the boundary with the substrate will be at least 3 mm.

14. A method as claimed in claim 13, in which the source of catalyst material is provided within the aggregation of the diamond grains in the form of admixed powder.

15. A method as claimed in claim 13, in which the source of catalyst material is provided within the aggregation of the diamond grains in the form of deposits on the diamond grains.

16. A method as claimed in claim 13 in which the aggregation of the diamond grains includes precursor material for the catalyst material.

17. A pick apparatus comprising a pick tool as claimed in claim 10 coupled to a vehicle for driving the pick tool against a body to be degraded.

* * * * *